US007924250B2

(12) United States Patent
Roy et al.

(10) Patent No.: US 7,924,250 B2
(45) Date of Patent: Apr. 12, 2011

(54) IMAGE DISPLAY DEVICE AND METHOD OF CONTROLLING SAME

(75) Inventors: Philippe Le Roy, Betton (FR); Sylvain Thiebaud, Noyal sur Vilaine (FR); Arnaud Trochet, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 885 days.

(21) Appl. No.: 11/883,962

(22) PCT Filed: Feb. 7, 2006

(86) PCT No.: PCT/FR2006/000279

§ 371 (c)(1),
(2), (4) Date: Aug. 8, 2007

(87) PCT Pub. No.: WO2006/084989

PCT Pub. Date: Aug. 17, 2006

(65) Prior Publication Data

US 2008/0062073 A1 Mar. 13, 2008

(30) Foreign Application Priority Data

Feb. 10, 2005 (FR) ..... 05 01357

(51) Int. Cl.
*G09G 3/32* (2006.01)

(52) U.S. Cl. ..... 345/82

(58) Field of Classification Search ..... 345/76–83
See application file for complete search history.

(56) References Cited

U.S. PATENT DOCUMENTS

| | | | | |
|---|---|---|---|---|
| 6,583,775 | B1 * | 6/2003 | Sekiya et al. | 345/76 |
| 2003/0052614 | A1 | 3/2003 | Howard | |
| 2003/0112205 | A1 * | 6/2003 | Yamada | 345/32 |
| 2004/0061671 | A1 | 4/2004 | Kawasaki et al. | |
| 2006/0007072 | A1 * | 1/2006 | Choi et al. | 345/76 |

OTHER PUBLICATIONS

Search Report Dated May 22, 2006.

* cited by examiner

*Primary Examiner* — Bipin Shalwala
*Assistant Examiner* — Steven E Holton
(74) *Attorney, Agent, or Firm* — Robert D. Shedd; Jeffrey M. Navon

(57) ABSTRACT

The invention relates to an image display device with active matrix comprising a number of light emitters forming a network divided into rows and columns; a current modulator for each emitter; and at least one inverse bias voltage generator. This device is characterized in that it also comprises:

an inverse bias switch for each emitter, said inverse bias switch being connected, on the one hand, to each modulator and, on the other hand, to the or each inverse bias voltage generator; and control electrodes able to drive all the inverse bias switches of a row of emitters.

The invention also relates to a method of driving this device.

9 Claims, 4 Drawing Sheets

$V_{32}$ $V_{56}$ $V_{34}$ $V_{58}$ $V_{40}$
$V_{data2}$ $V_P$
$V_{41}$
$V_{data6}$ $V_P$
T0 T1
T2 T3
T4 T5

$V_{70}$ $V_{71}$ $V_{72}$ $V_{74}$ $V_{40}$
$V_{data2}$ $V_P$
$V_{41}$
$V_{data6}$ $V_P$
$V_{76}$
$V_{data62}$ $V_P$
T0 T1
T2 T3
T4 T5

IMAGE DISPLAY DEVICE AND METHOD OF CONTROLLING SAME

This application claims the benefit, under 35 U.S.C. §365 of International Application PCT/FR2006/000279 filed Feb. 7, 2006, which was published in accordance with PCT Article 21(2) on Aug. 17, 2006 in French and which claims the benefit of French patent application No. 0501357, filed Feb. 10, 2005.

The present invention relates to an active matrix image display device comprising:

a) a number of light emitters forming a network, divided into rows and columns;

b) means of supplying power to the emitters;

c) means of controlling the emitters, comprising:

a current modulator for each emitter, the modulator comprising a source electrode, a drain electrode, a gate electrode, the modulator being able to be passed through by a drain current, to supply said emitter for a voltage between the source electrode and the gate electrode, greater than or equal to a trigger threshold voltage of this modulator;

a storage capacitor for each emitter, said capacitor comprising a first and second terminals and being able to store electrical charges at the gate electrode of each modulator;

addressing means able to address display data to the emitters of each column;

selection means able to select the emitters of each row, the selection means comprising a selection switch for each emitter, the selection switch being specifically for enabling addressing data supplied by the addressing means to be applied between the gate electrode and the source electrode of each modulator; and d) at least one inverse bias voltage generator specifically for applying a bias voltage that is the inverse of the bias of said addressing data between the gate electrode and the source electrode of each modulator to compensate for the variation in the trigger threshold voltage of each modulator.

An active matrix display device of the OLED (Organic Light-Emitting Diode) type comprises light emitters formed from organic light-emitting cells.

To control these emitters, such a device comprises thin-film transistors, called TFT transistors. These transistors are able to drive the current passing through the emitters. They are made of polycrystalline silicon, for example using the low temperature poly-silicon (LTPS) technology, or directly using amorphous silicon.

However, the TFT production technology introduces local spatial variations in the trigger threshold voltage of these transistors.

Consequently, the TFT transistors supplied by the same power supply voltage and controlled by identical voltages generate currents of differing intensities which may or may not cause a non-uniformity in the brightness of the display device made up of such transistors. The result is, for a given object of uniform luminance of an image to be displayed, spatial variations in the luminance of the pixels of the display device and a manifest visual discomfort for the user.

The instability of amorphous silicon is reflected in a variation in the characteristics of the TFT when a voltage is applied between the gate and the source of the TFT; more particularly, the trigger threshold voltage of the TFT transistors increases when a positive bias voltage is applied between their gate and their source and reduces when a negative bias voltage is applied between their gate and their source. Since the voltage applied between the gate and the source of the transistors generally differs from one transistor to another according to the luminance differences of the pixels of an image to be displayed, the degree of fluctuation of the trigger threshold voltage differs from one transistor to another. Consequently, the resulting luminance variation is distributed non-uniformly over the display device, and this results in variations over time in the luminance of the pixels of the display device and a manifest visual discomfort for the user.

In order to limit these drawbacks, various circuits for compensating the trigger threshold voltage drift have been proposed.

For example, document US 2003/0052614 describes an image display device of the abovementioned type. This device comprises, in particular, for each column of emitters, a control switch driven by a control electrode for moving this switch between a position of connection to an inverse bias generator and a position of connection to a column driver unit.

The inverse bias generator is specifically for applying, between the gate and the source of the modulators associated with the emitters of a column, an inverse bias voltage during so-called regeneration phases of the modulators, suitable for compensating the drifts in their trigger threshold voltage. This inverse bias voltage has a bias that is inverse to the bias of the addressing voltages applied between the gate and the source of these same modulators during emitter illumination phases.

It should be noted that the device described in document US2003/0112205 does not allow for an inverse bias voltage to be applied between the gate and the source of the modulators associated with the emitters of one and the same row: in practice, in this document, when an inverse bias is applied (see section 44), it is to the terminals of the emitters (see, for example, final sentence in paragraph 44) and not between the gate and the source of the modulators; in practice, during the inverse bias phases described here, the gate and the source of the modulators are raised to the same potential by the simultaneous closure of the switches referenced Tr3 and Tr4, and there is no bias, inverse or otherwise, between the gate and the source.

One aim of the invention is, in particular, to propose an alternative display device specifically for compensating the variations over time in the trigger threshold voltages.

The subject of the invention is a display device of the above-mentioned type, characterized in that it also comprises:

an inverse bias switch for each modulator, said inverse bias switch being connected between, on the one hand, the gate electrode of each modulator and the first terminal of the storage capacitor of this emitter, and, on the other hand, the or each inverse bias voltage generator and the second terminal of the storage capacitor of this emitter; and control electrodes, each control electrode being able to drive all of the inverse bias switches of a row of emitters.

According to particular embodiments, the display device comprises one or more of the following characteristics:

the selection means comprise selection electrodes specifically for driving the selection switches, said selection electrodes being separate and independent of the control electrodes;

the network formed by the emitters comprises a first group of rows of emitters and a second group of rows of emitters, the rows of the two groups being interposed, and each control electrode is connected to the gate of the inverse bias switches of a row of emitters of the first group and to the gate of the selection switches of a row of emitters of the second group to control the simultaneous closure of the selection switches and of the control switches belonging to these rows of emitters;

it comprises a single inverse bias voltage generator connected to all the inverse bias switches of the device;

it comprises a number of inverse bias voltage generators specifically for each to produce an inverse bias voltage that is specific and different from the inverse bias voltages produced by the other generators, each generator being connected only to all the inverse bias switches of a row of emitters.

Advantageously, this device divides by two the number of row electrodes contained in the device.

Another subject of the invention is a method of driving an image display device as claimed in claim 3, said device comprising, in turn, a first and a second rows of emitters, characterized in that the method comprises the following steps:

application of a first selection voltage to the control electrode connected to the selection switches of the first row of emitters, at a predefined frequency, application of a second selection voltage to the control electrode connected to the selection switches of the second row of emitters, at the same predefined frequency, and in that the applications of the first and second selection voltages are offset by a half-period, the duration of this half-period being equal to the duration of an image half-frame.

According to particular embodiments, the method of driving the display device comprises one or more of the following characteristics:

application of a selection voltage to the selection electrode, at a predefined frequency, application of a control voltage to the control electrode, at the same predefined frequency, the application of said control voltage being offset in time by a fraction of a period relative to the application of said selection voltage;

the fraction of a period is equal to a half-period;

the fraction of a period is equal to a third of a period; and the duration of a period is equal to the duration of an image frame.

The invention will be better understood from reading the description that follows, given purely as an example and with reference to the appended drawings, in which.

Figure 8:
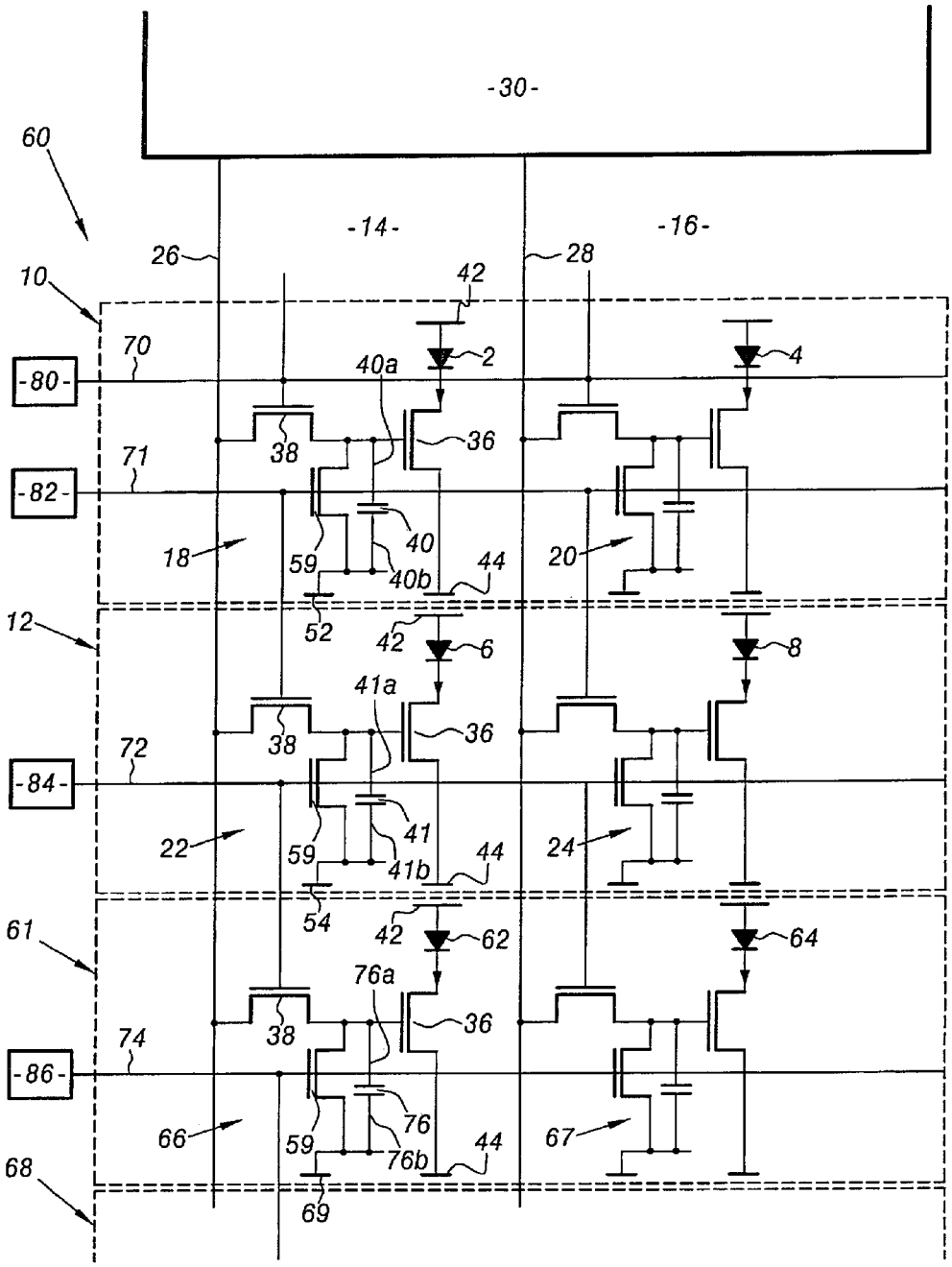
FIG. 8 is a diagrammatic view of a part of a display device according to a second embodiment of the invention.
Figures 9, 10, 11, 12, 13, 14, 15:
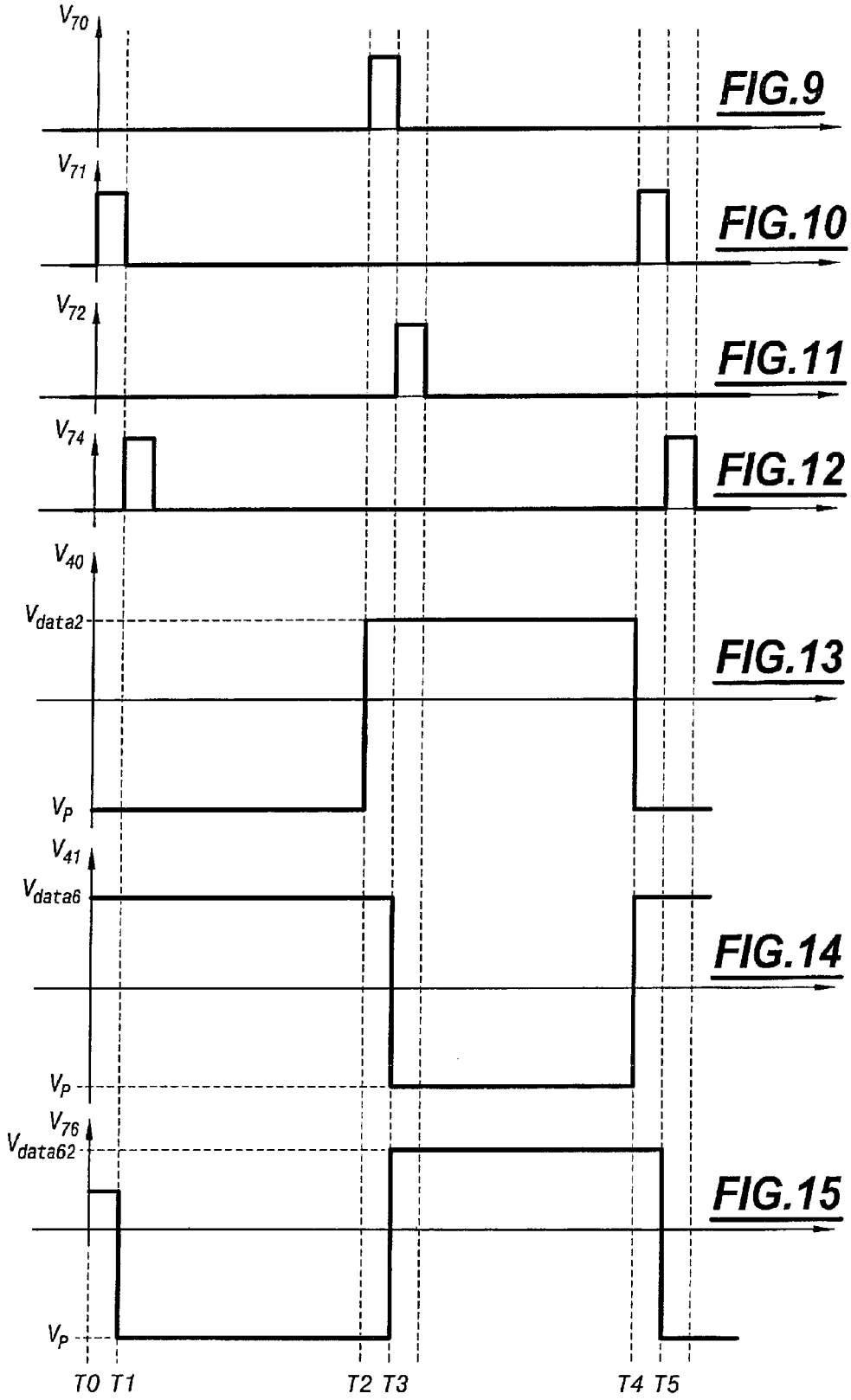

FIGS. 9, 10, 11 and 12 are graphs representing the trend over time of a control signal specifically for controlling an emitter of a first row of emitters, an emitter of a second row of emitters and an emitter of a third row of emitters and, respectively, the emitter of the third row of emitters and an emitter of a fourth row of emitters, of the device represented in FIG. 8; and FIGS. 13, 14 and 15 are graphs representing the trend over time of a voltage stored by a capacitor associated with the emitter of the first row of emitters, with the emitter of the second row of emitters and, respectively, associated with the emitter of the third row of emitters, of the device represented in FIG. 8.

Figure 1:
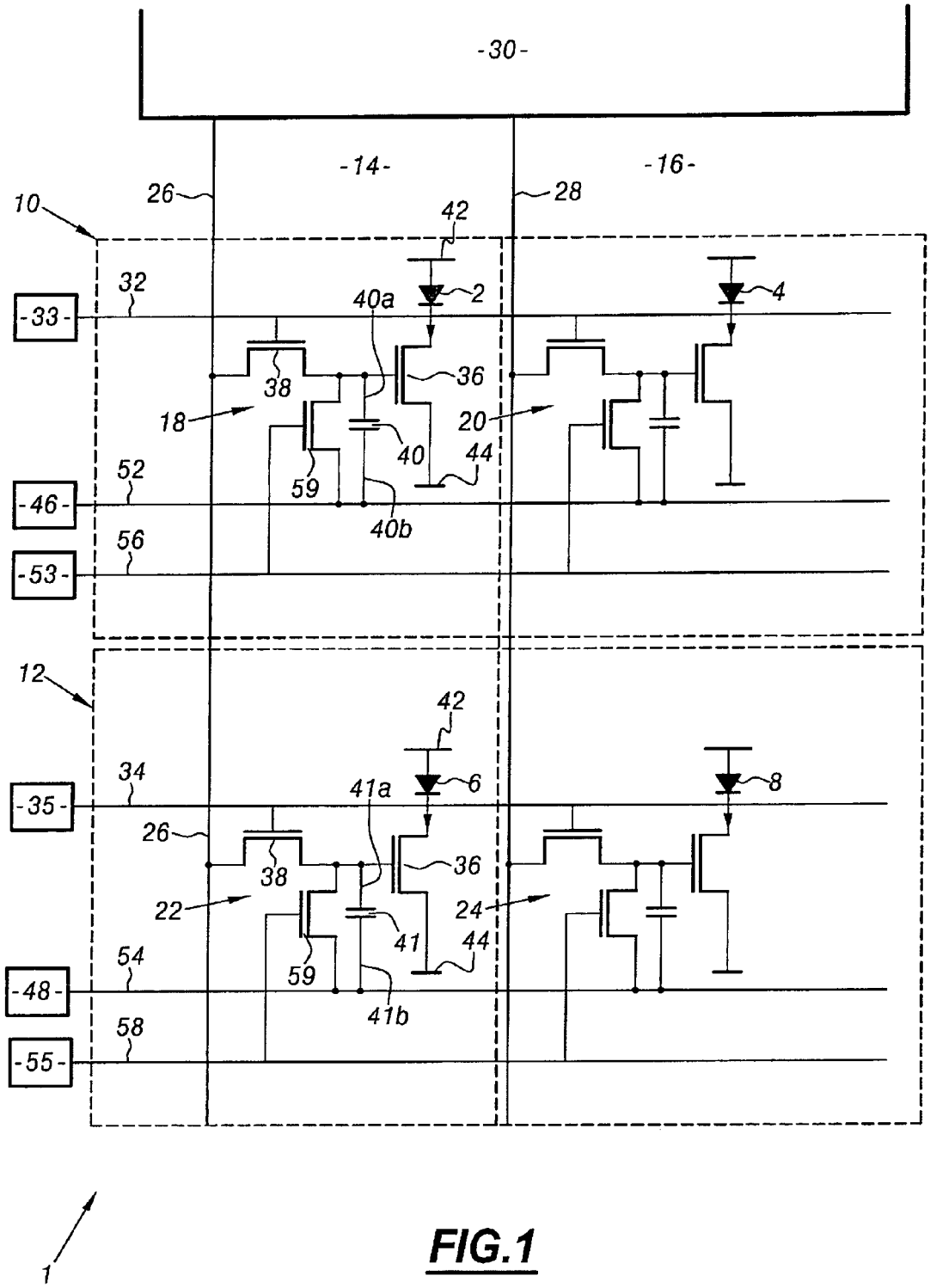
FIG. 1 is a diagrammatic view of a part of a display device according to a first embodiment of the invention.

A part of the display device 1 according to a first embodiment of the invention is illustrated diagrammatically in FIG. 1. The latter comprises light emitters 2, 4, 6, 8 divided into a network comprising rows and columns of emitters.

In FIG. 1, only a first 10 and a second 12 rows of emitters and a first 14 and second 16 columns of emitters are represented.

The emitters 2, 4, 6, 8 are organic light-emitting diodes. They comprise an anode and a cathode. They emit a light intensity directly proportional to the current that passes through them. Each emitter constitutes an individual pixel of the display device.

The display device also comprises addressing circuits 18, 20, 22, 24 divided into a network.

Each addressing circuit is connected to an emitter 2, 4, 6, 8 to drive it.

The addressing circuits 18, 22; 20, 24 of each column of emitters 14, 16 are addressed via an addressing electrode 26, 28 of this column of emitters. Each addressing electrode 26, 28 is connected to a column driver unit 30.

The driver unit 30 is specifically for receiving an image display signal and simultaneously transmitting to each addressing electrode 26, 28 of a column, an addressing voltage $V_{data}$ representative of a display data item for an emitter to be addressed in this column.

The addressing circuits 18, 20; 22, 24 of each row of emitters 10, 12 are selected via a selection electrode 32, 34, each connected to a selection driver unit 33, 35.

The selection driver unit 33, 35 of a row of emitters 10, 12 is suitable for generating, at a predefined frequency, a selection signal $V_{32}$, $V_{34}$ at the selection electrode 32, 34 of this row 10, 12 to select all the emitters 2, 4 and 6, 8 of this row 10, 12.

This selection signal comprises a series of pulses, each generated on each new image frame. These pulses are logical data for selecting an emitter from a row of emitters.

Since the addressing circuits 18, 20, 22 and 24 are identical, only the circuit 18 will be described in detail.

This circuit 18 comprises a current modulator 36, a selection switch 38, a storage capacitor 40 (referenced 41 in the addressing circuit 28 of the second row of emitters 12) and two power supply electrodes 42, 44.

The current modulator 36 and the switch 38 are thin-film transistors, based on a technology using polycrystalline silicon (Poly-Si), amorphous silicon (a-Si) or monocrystalline silicon (micro-Si) deposited in thin films on a glass substrate. Such components comprise three electrodes, a drain electrode and a source electrode between which circulates a modulated current called drain current, and a gate electrode.

The modulator 36 represented in FIG. 1 is of N type, such that, in operation, its drain current circulates from its drain to its source. It will be noted that the device according to the invention can also be used to drive P type TFT transistors.

The capacitor 40 is able to store electrical charges to maintain a voltage at the gate of the modulator 36 after the transmission of an addressing voltage.

The capacitor 40 comprises a first terminal 40*a* connected to the gate of the modulator 36 and a second terminal 40*b* connected to an inverse bias electrode 52.

The drain of the modulator 36 is connected to the cathode of the emitter 2. The source of the modulator 36 is connected to the supply electrode 44 which is maintained at a constant potential. The gate of the modulator 36 is connected, on the one hand, to a first terminal of the capacitor 40 and, on the other hand, to a current passing electrode (drain or source) of the switch 38. The other current passing electrode (drain or source) of the switch 38 is connected to the addressing electrode 26. The gate of the switch 38 is connected to the selection electrode 32. The anode of the emitter 2 is connected to the power supply electrode 42.

The display device 1 also comprises, for each row of emitters 10, 12, an inverse bias generator 46, 48 connected to an inverse bias electrode 52, 54 and an inverse bias control generator 53, 55 connected to an inverse bias control electrode 56, 58.

The inverse bias generators 46 and 48 are able each to generate, between the gate and the source of the modulators 36, a bias voltage $V_p$, of values that may differ between themselves and of a bias that is the inverse of the bias of the addressing voltages $V_{data}$ applied between the gate and the source of the modulators 36 in the emission phases of the emitters 2, 4, 6, 8.

The inverse bias electrode 52, 54 is connected to the second terminal of the capacitor 40, 41 of each addressing circuit of a row of emitters 10, 12.

The inverse bias control generators 53, 55 are suitable for producing an inverse bias control signal $V_{56}$, $V_{58}$, similar to the selection signal $V_{32}$, $V_{34}$, of the same frequency and offset by a half-period or period that varies relative to this selection signal.

The device 1 also comprise an inverse bias switch 59 in each addressing circuit 18, 20, 22, 24.

This switch 59 is a thin-film transistor of the same type as the switch 38 and the modulator 36.

A current passing electrode (source or drain) of the switch 59 of each addressing circuit of a row of emitters 10, 12 is connected to the inverse bias electrode 52, 54 of this row of emitters 10, 12 and, consequently, also to the second terminal 40*b* of the capacitor 40, 41. The other current passing electrode (source or drain) of the switch 59 is connected to the gate of the modulator 36, and consequently, also to the first terminal 40*a* of the capacitor 40, 41. The gate of the switch 59 of each addressing circuit of a row of emitters 10, 12 is connected to the inverse bias control electrode 56, 58 of this same row of emitters 10, 12.

Only the operation of the emitters 2, 6 of the first column 14 and of the first 10 and the second 12 rows of emitters is described in detail.

Figures 2, 3, 4, 5, 6, 7:
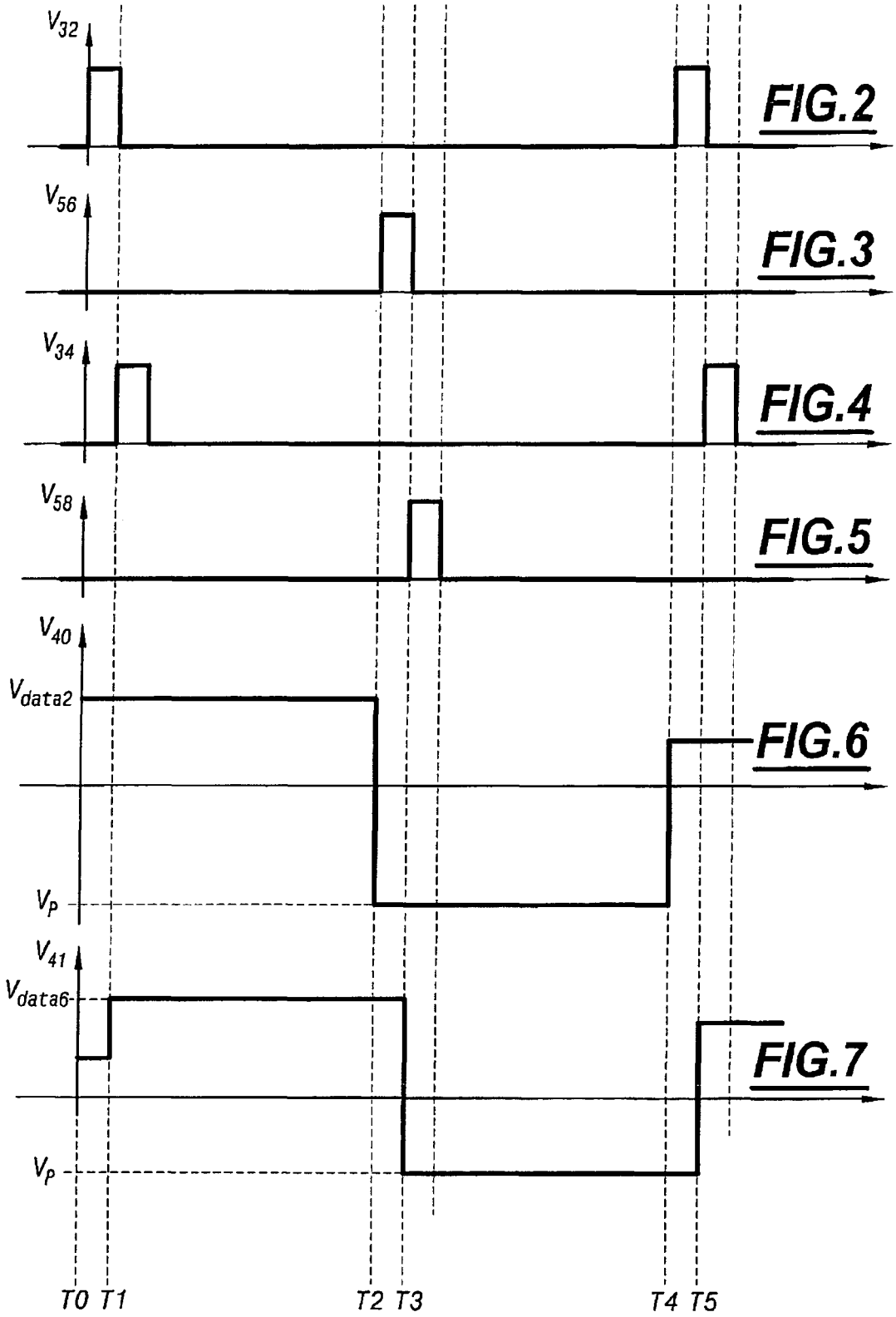
FIGS. 2 and 4 are graphs representing the trend over time of a selection signal specifically for selecting a first and, respectively, a second emitters of the device represented in FIG. 1.
FIGS. 3 and 5 are graphs representing the trend over time of a control signal specifically for controlling the first and, respectively, the second emitters of the device represented in FIG. 1.
FIGS. 6 and 7 are graphs representing the trend over time of a voltage associated with the first emitter and, respectively, the second emitter of the device represented in FIG. 1.

At the time T=T0, a pulse of the selection signal $V_{32}$ represented in FIG. 2 is generated at the selection electrode 32 of the first row of emitters 10. Simultaneously, the driver unit 30 addresses an addressing voltage $V_{data2}$ to the addressing electrode 26. The value of this addressing voltage is referenced to the constant potential of the power supply electrode 44.

Consequently, the switches 38 of the first row of emitters 10 are closed and the voltage $V_{data2}$ is applied to the first terminal 40*a* of the capacitor 40 and between the gate and the source of the modulator 36 of the addressing circuit 18, as can be seen in FIG. 6. After the end of the pulse of the selection signal $V_{32}$, the switches 38 of the first row of emitters 10 open and the voltage $V_{data2}$ is maintained, by the capacitor 40, between the gate and the source of the modulator 36 of the addressing circuit 18, as can be seen in FIG. 6.

Since the voltage $V_{data2}$ is greater than the trigger threshold voltage of the modulator 36, a drain current passes through the emitter 2 which is illuminated.

At the time T=T1, a pulse of the selection signal $V_{34}$ represented in FIG. 4 is applied to the selection electrode 34. Simultaneously, the driver unit 30 addresses an addressing voltage $V_{data6}$ to the addressing electrode 26. The value of this addressing voltage is also referenced to the constant potential of the power supply electrode 44.

Consequently, the switches 38 of the second row of emitters 12 close and the voltage $V_{data6}$ is applied to the capacitor 41 and between the gate and the source of the modulator 36 of the addressing circuit 22 of the second row of emitters 12. Since the voltage $V_{data6}$ is greater than the trigger threshold voltage of the modulator 36, a drain current passes through the emitter 6 which is illuminated. After the end of the pulse of the selection signal $V_{34}$, the switches 38 of the second row of emitters 12 open and the voltage $V_{data6}$ is maintained, by the capacitor 41, between the gate and the source of the modulator 36 of the addressing circuit 22, as can be seen in FIG. 7.

This step is repeated in succession for each emitter of a row, row after row for all the rows of the display device during a period ranging from T=T1 to T=T4.

At the same time, at the time T=T2, a pulse of the control signal $V_{56}$ represented in FIG. 3 is applied to the control electrode 56.

This pulse closes the switches 59 of the first row of emitters 10, such that the inverse bias voltage $V_p$ generated by the generator 46 is applied between the gate and the source of the modulator 36 of the addressing circuit 18; since the switch 59 then short circuits the two terminals of the capacitor 40, this capacitor is discharged. After the end of the pulse of the control signal $V_{56}$, the switches 59 of the first row of emitters 10 open and the voltage $V_p$ is maintained between the gate and the source of the modulator 36 of the addressing circuit 18, as can be seen in FIG. 6, because the capacitor 40 retains a zero charge.

Then, at the time T=T3, a pulse of the control signal $V_{58}$ represented in FIG. 5 is applied to the control electrode 58 of the second row of emitters 12 to close the switches 59 of this second row 12. Consequently, the inverse bias voltage $V_p$ generated by the generator 48 is applied to the second terminal of the capacitor 41 and to the gate of the modulator 36 of the addressing circuit 22 of the second row of emitters 12; since the switch 59 then short circuits the two terminals of the capacitors 41, this capacitor is discharged. After the end of the pulse of the control signal $V_{58}$, the switches 59 of the second row of emitters 12 open and the voltage $V_p$ is maintained between the gate and the source of the modulator 36 of the addressing circuits 22, as can be seen in FIG. 7, because the capacitor 41 retains a zero charge.

At the time T=T4, the step performed at the time T=T0 is repeated. Thus, a pulse of the selection signal $V_{32}$ represented in FIG. 2 is applied to the selection electrode 32. Simultaneously, the driver unit 30 addresses a new addressing voltage to the addressing electrode 26.

At the time T=T5, the step performed at the time T=T1 is repeated.

Then, the operating method of the device according to the invention continues by repeating the steps described above.

The duration of T0 to T4 corresponds to the duration of an image frame. The duration of an image frame is divided into two phases, in this case T0 to T2 and T2 to T4, for example each of a duration equal to the duration of an image half-frame.

During a first phase (corresponding to the durations of T=T0 to T=T2 and of T=T1 to T=T3), the emitters of the screen are illuminated, and during a second phase (corresponding to the durations of T=T2 to T=T4 and of T=T3 to T=T5), the emitters are off. The ratio of these durations between the first phase and the second phase is 50/50.

In a variant, the ratio of the durations between the first phase and the second phase is 60/40 or 70/30.

During the emission phases of the emitters, the addressing voltages $V_{data}$ of display data applied between the gate and the source of the modulators 36 connected to these emitters, are specifically for varying the trigger threshold voltages of the modulators 36 in a first direction.

During the off phases of the emitters, the inverse bias voltages $V_p$ are applied between the gate and the source of the modulators 36 connected to these emitters to vary their trigger threshold voltage in the reverse directions so as to compensate for any drift in this threshold voltage.

Since the inverse bias voltages $V_p$ represented in FIGS. 6 and 7 have a bias that is the reverse of the bias of the addressing voltages $V_{data2}$, $V_{data6}$ previously applied to the modulators 36, they are specifically for reducing the trigger threshold voltage of the modulators 36 in order to return the latter to the initial trigger threshold voltage (before application of the addressing voltage).

A part of the display device 60 according to a second embodiment of the invention is diagrammatically illustrated in FIG. 8.

The elements of the second embodiment illustrated in FIG. 8 that are identical or similar to the elements of the first embodiment illustrated in FIG. 1 are designated by the same reference numerals as in FIG. 1, and are not described a second time.

FIG. 8 representing the device 60 comprises in addition to the part of the device 1 represented in FIG. 1, a third row of emitters 61, comprising emitters 62 and 64, each driven by an addressing circuit 66, 67, and a fourth row of emitters 68 not shown in detail.

The circuit 66 is identical to the circuits 18, 20, 22, 24. It comprises a capacitor referenced 76 having a first 76*a* and a second 76*b* terminals, and an inverse bias electrode referenced 69 similar to the electrodes 52 and 54 and connected to the second terminal 76*b* of the capacitor 76 and to a current passing electrode of the switch 59.

The inverse bias generators 46, 48 connected to the electrodes 52, 54 and 69 are not represented to simplify FIG. 8.

The device 60 comprises control electrodes for selection and for inverse biasing 70, 71 and 72 by replacing selection electrodes 32, 34 and inverse bias control electrodes 56 and 58 of the device 1 and an additional control electrode referenced 74.

The control electrode 70 is connected to all the inverse bias control switches 59 of a row of emitters not shown, positioned just above the first row 10, and to all the selection switches 38 of the first row of emitters 10.

The control electrode 71 is connected to all the inverse bias control switches 59 of the first row of emitters 10, and to all the selection switches 38 of the second row of emitters 12.

Similarly, the control electrode 72, respectively the control electrode 74, is connected to all of the inverse bias control switches 59 of the second row of emitters 12, respectively of the third row of emitters 61, and to all the selection switches 38 of the third row of emitters 61, respectively of the fourth row of emitters 68.

Thus, the inverse bias control switches 59 of a row are connected to the same control electrode as the selection switches 38 of the next row.

The device 60 also comprises control generators 80, 82, 84, 86, each connected to a control electrode 70, 71, 72, 74.

The generators 80, 82, 84, 86 are specifically for producing a control signal $V_{70}$, $V_{71}$, $V_{72}$, $V_{74}$ of the same frequency. As can be seen in FIGS. 9 to 12, the control signals $V_{70}$, $V_{71}$ applied to the electrodes of two adjacent rows 10, 12 are offset by an image half-period.

Only the operation of the emitters 6 and 62 of the first column 14 and of the first 10, of the second 12 and of the third 61 rows of emitters is described in detail.

At the time T=T0, a pulse of the control signal $V_{71}$ represented in FIG. 10 is transmitted to the control electrode 71. This pulse provokes the closure of the inverse bias switches 59 of the first row of emitters 10 and of the selection switches 38 of the second row of emitters 12.

Simultaneously, an addressing voltage $V_{data6}$ representative of an image data item is applied to the addressing electrode 26 by the driver unit 30. The value of this addressing voltage is referenced to the constant potential of the power supply electrode 44.

Since the switches 59 of the first row of emitters 10 are closed, the inverse bias voltage $V_p$ obtained from the inverse bias electrode 52 is applied between the gate and the source of the modulators 36 and to the terminals of the capacitors 40 of the first row of emitters 10. Since the switch 59 then short circuits the two terminals of the capacitor 40, this capacitor is discharged. After the end of the pulse of the control signal $V_{71}$, the switches 59 of the first row of emitters 10 open and the voltage $V_p$ is maintained between the gate and the source of the modulator 36 of the addressing circuit 18, as can be seen in FIG. 13, because the capacitor 40 retains a zero charge.

In parallel, since the switches 38 of the second row of emitters 12 are simultaneously closed, the addressing voltage $V_{data6}$ obtained from the electrode 26 is applied to the first terminal 41*a* of the capacitor 41 and to the gate of the modulator 36 of the second row of emitters 12, as can be seen in FIG. 14.

Consequently, the emitter 2 is off and the emitter 6 is illuminated. After the end of the pulse of the control signal $V_{71}$, the switches 38 of the second row of emitters 12 open and the voltage $V_{data6}$ is maintained, by the capacitor 41, between the gate and the source of the modulator 36 of the addressing circuit 22, as can be seen in FIG. 14.

At the time T=T1, a pulse of the control signal $V_{74}$ represented in FIG. 12 is applied to the control electrode 74. The application of this pulse provokes the closure of the switches 59 of the third row of emitters 61. Following this closure, the inverse bias voltage $V_p$ of the inverse bias electrode 69 is applied between the gate and the source of the modulator 36 and to the terminals of the capacitor 76 of the third row of emitters 61, as can be seen in FIG. 15.

Consequently, the emitter 62 goes off.

Since the switch 59 then short circuits the two terminals of the capacitor 76, this capacitor is discharged. After the end of the pulse of the control signal $V_{74}$, the switches 59 of the third row of emitters 66 open and the voltage $V_p$ is maintained between the gate and the source of the modulator 36 of the addressing circuit 66, as can be seen in FIG. 15, because the capacitor 76 retains a zero charge.

At the time T=T2, a pulse of the control signal $V_{70}$ represented in FIG. 9 is applied to the control electrode 70 by the generator 80, and an addressing voltage $V_{data2}$ is applied to the addressing electrode 26 by the addressing driver unit 30. The value of this addressing voltage is also referenced to the constant potential of the power supply electrode 44.

Consequently, the addressing voltage $V_{data2}$, as represented in FIG. 13 is applied to the gate of the modulator 36 and to the terminals of the capacitor 40 of the first row of emitters 10 and the emitter 2 is illuminated.

After the end of the pulse of the control signal $V_{70}$, the switches 38 of the first row of emitters 10 open and the voltage $V_{data2}$ is maintained, by the capacitor 40, between the gate and the source of the modulator 36 of the addressing circuit 18, as can be seen in FIG. 13.

At the time T=T3, a pulse of the control signal $V_{72}$ represented in FIG. 11 is applied to the control electrode 72. This provokes the closure of the inverse bias switches 59 of the second row of emitters 12 and the closure of the selection switches 38 of the third row of emitters 61. Since the switch 59 then short circuits the two terminals of the capacitor 41, this capacitor is discharged. After the end of the pulse of the control signal $V_{72}$, the switches 59 of the second row of emitters 12 open and the voltage $V_p$ is maintained between the gate and the source of the modulator 36 of the addressing circuit 22, as can be seen in FIG. 14, because the capacitor 41 retains a zero charge.

Consequently, the inverse bias voltage $V_p$ of the inverse bias electrode 54 is applied between the gate and the source of the modulator 36 and to the terminals of the capacitor 41 of the second row of emitters 12, as can be seen in FIG. 14.

Then, the emitter 6 goes off.

In parallel, an addressing voltage $V_{data\text{-}62}$, as represented in FIG. 15 is transmitted by the electrode 26 and applied to the gate of the modulator 36 and to a terminal of the capacitor 76 of the third row of emitters 61. Consequently, the emitter 62 is illuminated.

At the time T=T4 and T=T5, the steps performed at the times T=0 and T=1 are repeated, respectively.

The time periods ranging from T=T0 to T=T4 and from T=T1 to T=T5 each correspond to the duration of an image, here comprising two interlaced frames.

According to this embodiment of the invention, the emitters of a group comprising the odd rows 10, 61 of the device, are off during a first frame T0-T2; T1-T3, then illuminated during a second frame T2-T4; T3-T5.

Conversely, the emitters of another group comprising the even rows 12, 68 of the device are illuminated during a first frame T0-T2; T1-T3 then off during a second frame T2-T4; T3-T5.

Without departing from the invention, the order between the odd frames and the even frames can be reversed.

When the emitters 2, 4 of the first row 12 are off, the emitters 6, 8 of the second row 12 are illuminated and vice-versa.

Advantageously, this second embodiment of the invention facilitates the addressing of the display data when the display mode is interlaced because the driver unit 30 does not need to recompute the scaling of the data to be addressed of the display signal that it receives, to return to the "progressive" mode.

In practice, when using an interlaced display mode, the emitters of a row are addressed on all the columns simultaneously, for all the even rows on a first frame, then for all the odd rows on a second frame.

Advantageously, this second embodiment of the invention makes it possible to reduce the number of row electrodes because the control electrodes 70, 71, 72, 74 can be used to control both the addressing of the addressing voltages and the addressing of the inverse bias voltages.

Advantageously, this device makes it possible not to use a driver unit specifically for addressing the positive and negative bias voltages. This type of driver unit is, in practice, costly.

As a variant, the inverse bias electrodes 52, 54, 69 of all the display device are linked to a single inverse bias voltage generator.

The invention claimed is:

1. An image display device with active matrix comprising:

a) a number of light emitters forming a network, divided into rows and columns;

b) means for supplying power to the emitters;

c) means of controlling the emitters comprising:

a current modulator for each emitter, the modulator comprising a source electrode, a drain electrode, a gate electrode, the modulator being able to be passed through by a drain current, to supply said emitter for a voltage between the source electrode and the gate electrode, greater than or equal to a trigger threshold voltage of this modulator;

a storage capacitor for each emitter, said capacitor comprising a first and a second terminals and being able to store electrical charges at the gate electrode of each modulator;

addressing means able to address display data to the emitters of each column;

selection means able to select the emitters of each row, the selection means comprising a selection switch for each emitter, the selection switch being specifically for enabling addressing data supplied by the addressing means to be applied between the gate electrode and the source electrode of each modulator; and d) at least one inverse bias voltage generator specifically for applying an inverse bias voltage of the bias of said addressing data between the gate electrode and the source electrode of each modulator;

wherein the image display device also comprises:

an inverse bias switch for each modulator to compensate for the variation in the trigger threshold voltage of each modulator, said inverse bias switch being connected between, on the one hand, the gate electrode of each modulator and the first terminal of the storage capacitor of this emitter, and, on the other hand, the or each inverse bias voltage generator and the second terminal of the storage capacitor of this emitter; and control electrodes, each control electrode being able to drive all of the inverse bias switches of a row of emitters.

2. The device as claimed in claim 1, wherein the selection means comprise selection electrodes specifically for driving the selection switches, said selection electrodes being separate and independent of the control electrodes.

3. The device as claimed in claim 1, wherein the network formed by the emitters comprises a first group of rows of emitters and a second group of rows of emitters, the rows of the two groups being interposed, and in that each control electrode is connected to the gate of the inverse bias switches of a row of emitters of the first group and to the gate of the selection switches of a row of emitters of the second group to control the simultaneous closure of the selection switches and of the control switches belonging to these rows of emitters.

4. The device as claimed in claim 1, wherein it comprises a single inverse bias voltage generator connected to all the inverse bias switches of the device.

5. The device as claimed in claim 1, wherein it comprises a number of inverse bias voltage generators specifically for each to produce an inverse bias voltage that is specific and different from the inverse bias voltages produced by the other generators, each generator being connected only to all the inverse bias switches of a row of emitters.

6. A method of driving an image display device as claimed in claim 3, said device comprising, in turn, a first and a second row of emitters, wherein the method comprises the following steps:

application of a first selection voltage to the control electrode connected to the selection switches of the first row of emitters, at a predefined frequency, application of a second selection voltage to the control electrode connected to the selection switches of the second row of emitters, at the same predefined frequency, wherein the applications of the first and second selection voltages are offset by a half-period, the duration of this half-period being equal to the duration of an interlaced frame, wherein an image comprises two interlaced frames.

7. A method of driving an image display device as claimed in claim 2, said device comprising, in turn, a first and a second row of emitters, wherein the method comprises the following steps:

illuminating the emitters of the screen during a first phase, switching off said emitters during a second phase, the first phase being offset in time by a fraction of a period relative to the second phase, wherein the first and the second phase constitute an image frame.

8. The method as claimed in claim 7, wherein the fraction of a period is equal to a half of the image frame.

9. The drive method as claimed in claim 7, wherein the duration of the period is equal to the duration of the image frame.

* * * * *